US011644761B2

(12) United States Patent
Kodama et al.

(10) Patent No.: US 11,644,761 B2
(45) Date of Patent: May 9, 2023

(54) ELECTROPHOTOGRAPHIC ROLLER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Katsuya Kodama, Kanagawa (JP); Toshiro Suzuki, Shizuoka (JP); Kenichi Yazawa, Shizuoka (JP); Atsushi Uematsu, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/664,895

(22) Filed: May 25, 2022

(65) Prior Publication Data

US 2022/0390876 A1 Dec. 8, 2022

(30) Foreign Application Priority Data

Jun. 2, 2021 (JP) ..... JP2021-093293
May 6, 2022 (JP) ..... JP2022-076789

(51) Int. Cl.
*G03G 15/02* (2006.01)
*G03G 21/18* (2006.01)

(52) U.S. Cl.
CPC ..... *G03G 15/0216* (2013.01); *G03G 21/1814* (2013.01); *G03G 15/0233* (2013.01)

(58) Field of Classification Search
CPC ..... G03G 15/0216; G03G 21/1814; G03G 15/0233; G03G 15/1685; G03G 15/0818
See application file for complete search history.

(56) References Cited

U.S. PATENT DOCUMENTS 4,420,548 A 12/1983 Sakai
5,459,558 A * 10/1995 Ishiyama ..... G03G 15/0233 399/176
7,693,457 B2 4/2010 Kuruma
7,962,068 B2 6/2011 Kuroda
8,064,803 B2 11/2011 Kuroda
8,538,298 B2 9/2013 Harada
8,712,291 B2 4/2014 Suzuki
(Continued)

FOREIGN PATENT DOCUMENTS

EP 0 458 273 A2 11/1991
EP 2 787 394 A 10/2014
(Continued)

*Primary Examiner* — Sandra Brase
(74) *Attorney, Agent, or Firm* — Venable LLP

(57) ABSTRACT

An electrophotographic roller includes: a mandrel and an elastic layer on the mandrel, and having a crown shape in which a diameter decreases from a central position O in a longitudinal direction of the mandrel toward an end portion. When a position of the end portion in the longitudinal direction of the elastic layer is defined as X2, a position between the O and the X2 is defined as X1, a distance between the O and the X1 is defined as L1, and a distance between the X1 and the X2 is defined as L2, L1=0.6×(L1+L2). When outer diameters of the electrophotographic roller at O, X1 and X2 are defined as Do, DX1 and DX2, respectively, and Z1=(Do−DX1)/2 and Z2=(DX1−DX2)/2 are defined, Z1, Z2, L1 and L2 satisfy (Z2/L2)<1.931×(Z1/L1).

12 Claims, 9 Drawing Sheets

(56) References Cited

U.S. PATENT DOCUMENTS

| | | | | |
|---|---|---|---|---|
| 9,075,333 | B2 | 7/2015 | Uematsu | |
| 9,098,006 | B2 | 8/2015 | Uematsu | |
| 9,274,442 | B2 | 3/2016 | Sato | |
| 9,411,307 | B2 | 8/2016 | Matsuda | |
| 9,448,502 | B2 | 9/2016 | Taniguchi | |
| 9,599,914 | B2 | 3/2017 | Uematsu | |
| 9,904,199 | B2 | 2/2018 | Terada | |
| 9,910,379 | B2 | 3/2018 | Furukawa | |
| 10,025,216 | B2 | 7/2018 | Uematsu | |
| 10,146,149 | B2 | 12/2018 | Watanabe | |
| 10,248,042 | B2 | 4/2019 | Uematsu | |
| 2011/0249372 | A1* | 10/2011 | Takano | G03G 15/0233 361/225 |
| 2012/0076539 | A1 | 3/2012 | Sato | |
| 2019/0212669 | A1* | 7/2019 | Kuroda | G03G 15/0818 |
| 2022/0236662 | A1 | 7/2022 | Uematsu | |

FOREIGN PATENT DOCUMENTS

| | | | |
|---|---|---|---|
| JP | 11-143178 | A | 5/1999 |
| JP | 2000-206762 | A | 7/2000 |
| JP | 2001-350351 | A | 12/2001 |
| JP | 2006-323163 | A | 11/2006 |
| JP | 2007-206148 | A | 8/2007 |
| JP | 2009-116009 | A | 5/2009 |
| JP | 2011-43684 | A | 3/2011 |
| JP | 2013-40627 | A | 2/2013 |
| JP | 2013-205674 | A | 10/2013 |
| JP | 2019-82673 | A | 5/2019 |

* cited by examiner

η IT = 40

η IT = 56

ELECTROPHOTOGRAPHIC ROLLER, PROCESS CARTRIDGE AND ELECTROPHOTOGRAPHIC IMAGE FORMING APPARATUS

BACKGROUND

Technical Field

The present disclosure relates to an electrophotographic roller, and a process cartridge and an electrophotographic image forming apparatus including the same.

Description of the Related Art

An electrophotographic image forming apparatus (hereinafter also referred to as "electrophotographic apparatus") which adopts an electrophotographic system mainly includes an electrophotographic photosensitive member (hereinafter also referred to as "photosensitive member"), a charging apparatus, an exposure apparatus, a developing apparatus, a transfer apparatus and a fixing apparatus.

Members having a roller shape, a blade shape or the like are suitably used for the charging apparatus, the developing apparatus and the transfer apparatus. In these apparatuses, an apparatus which is particularly preferably used is a roller-shaped member (hereinafter also referred to as "electrophotographic roller").

An outer-diameter shape of the electrophotographic roller to be used in the electrophotographic apparatus is required to be highly accurate in both the circumferential direction and the longitudinal direction.

Here, the shape will be described that is required in an electrophotographic roller (hereinafter also referred to as "charging roller") which is used for the charging apparatus. When the charging roller is brought into contact with the photosensitive member, it is general to apply a predetermined force to both end portions of a shaft of the charging roller, and press the charging roller against the photosensitive member. In this case, a "crown shape" is known as a shape of the charging roller which is adopted for the purpose of uniformizing a "nip width" in the longitudinal direction (refer to Japanese Patent Application Laid-Open No. 2000-206762 and Japanese Patent Application Laid-Open No. 2006-323163). Note that the "nip width" refers to the width at which the charging roller and the photosensitive drum come into contact with each other. The "crown shape" refers to a shape in which the outer diameter of the charging roller decreases from the central portion to both end portions, specifically, a shape in which the diameter decreases from the central position of the length in a direction orthogonal to the circumferential direction of the charging roller (hereinafter also referred to as "longitudinal direction") toward both ends.

However, according to studies by the present inventors, there has been a case where the charging roller having the crown shape causes blots on the surface of the end region due to the sticking of the toner or an external additive of the toner, along with being used. In particular, this phenomenon has been more conspicuous in recent electrophotographic apparatuses that have been speeded up.

SUMMARY

At least one aspect of the present disclosure is directed to providing an electrophotographic roller that can suppress the adhesion of blots in an end region of the electrophotographic roller, even in a high-speed electrophotographic apparatus.

In addition, another aspect of the present disclosure is directed to providing a process cartridge that contributes to stable formation of a high-quality electrophotographic image.

Furthermore, another aspect of the present disclosure is directed to providing an electrophotographic apparatus that can stably form a high-quality electrophotographic image.

According to one aspect of the present disclosure, there is provided an electrophotographic roller including a mandrel and an elastic layer on the mandrel, and having a crown shape in which a diameter decreases from a central position O in a longitudinal direction of the mandrel toward both ends thereof, wherein when a position of the end portion in the longitudinal direction of the elastic layer is defined as X2, a position between the central position O and the X2 is defined as X1, a distance between the central position O and the X1 is defined as L1, and a distance between the X1 and the X2 is defined as L2, $$L1=0.6\times(L1+L2), \text{ and}$$

when outer diameters of the electrophotographic roller at O, X1 and X2 are defined as Do, DX1 and DX2, respectively, and Z1 and Z2 are defined as follows:

$$Z1=(Do-DX1)/2, \text{ and}$$

$$Z2=(DX1-DX2)/2$$

Z1, Z2, L1 and L2 satisfy a relationship expressed by the following calculation expression (1):

$$(Z2/L2)<\alpha\times(Z1/L1) \quad (1),$$

wherein $\alpha$ in the calculation expression (1) is 1.931.

According to another aspect of the present disclosure, there is provided a process cartridge including the above electrophotographic roller and an electrophotographic photosensitive member, and being configured to be detachably attachable to a main body of an electrophotographic apparatus.

According to further another aspect of the present disclosure, there is provided an electrophotographic apparatus including the above electrophotographic roller and an electrophotographic photosensitive member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

The present inventors presume the cause of the above adhesion of the blot to the end region of the charging roller having the crown shape, as follows. Specifically, the charging roller generally comes into contact with the photosensitive member and follows the driving thereof. At this time, in the charging roller having the crown shape, a difference in a peripheral speed occurs between the charging roller and the photosensitive member depending on the position in the longitudinal direction. Then, the difference in the peripheral speed becomes large in the end region, and the toner and the external additive of the toner on the photosensitive member are rubbed against the surface of the charging roller. It is considered that it becomes thereby easier for the end region to be more blotted.

Then, the present inventors have repeatedly studied to prevent the adhesion of the blot due to the difference in the peripheral speed in the end region of the electrophotographic roller having the crown shape. As a result, the present inventors have found that the electrophotographic roller having the specific crown shape as described above contributes to the achievement of the above object.

Embodiments according to the present disclosure will be described below in detail with reference to the drawings. However, the dimensions, materials, shapes, relative arrangements and the like of the constituent components described in the embodiments should be appropriately changed according to the configuration, various conditions and the like of an apparatus to which the disclosure is applied, and the scope of this disclosure is not intended to be limited to the following embodiments.

Figure 2:
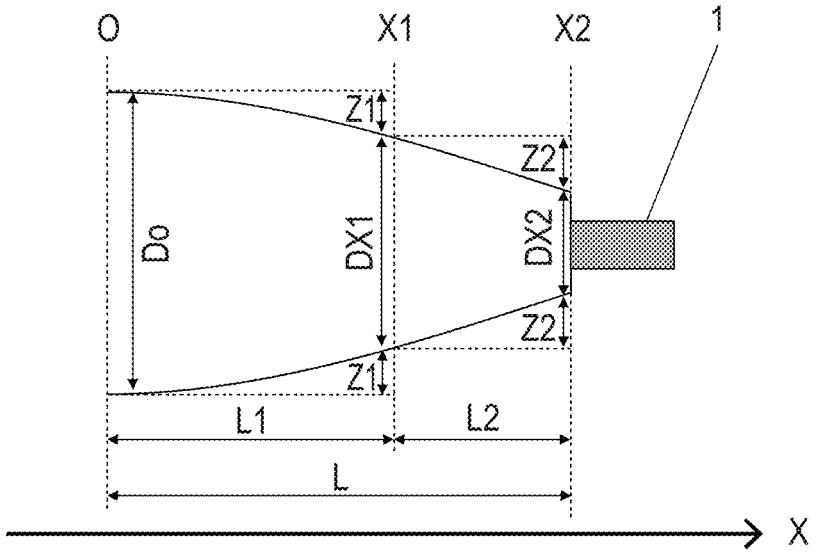
FIG. 2 illustrates a view for describing a shape of a charging roller according to one embodiment of the present disclosure.

FIG. 2 illustrates a shape of the electrophotographic roller according to the present disclosure. FIG. 2 illustrates an enlarged view from the center of the electrophotographic roller in the longitudinal direction to one end portion of the mandrel 1.

An electrophotographic roller according to one aspect of the present disclosure includes a mandrel and an elastic layer on the mandrel; and has a crown shape in which the diameter decreases from the central portion toward both ends in a longitudinal direction of the mandrel. In addition, when a position of an end portion in a longitudinal direction of the elastic layer is defined as X2, a position between a central position O and X2 is defined as X1, a distance between the central position O and X1 is defined as L1, and a distance between the X1 and X2 is defined as L2, L1=0.6×(L1+L2), and when outer diameters of the electrophotographic roller at O, X1 and X2 are defined as Do, DX1 and DX2, respectively, and Z1=(Do−DX1)/2 and Z2=(DX1−DX2)/2 are defined, Z1, Z2, L1 and L2 satisfy a relationship expressed by the following calculation expression (1):

$$(Z2/L2)<\alpha\times(Z1/L1) \quad (1),$$

wherein α is 1.931.

An electrophotographic roller according to one aspect of the present disclosure will be described below in detail.

[Crown Amount]

Firstly, a crown amount will be described. A charging roller which is commonly used is brought into contact with a photosensitive member so that a predetermined pressure is applied to both end portions of a mandrel 1. Because of this, when the outer diameter of the elastic layer of the charging roller is constant from the central position in the longitudinal direction of the mandrel to the end portions of the elastic layer, the pressing force at the end portion becomes larger than the pressing force at the central portion. In order to reduce the unevenness of the pressure distribution in the longitudinal direction, the charging roller has such a crown shape that the diameter decreases from the center in the longitudinal direction of the mandrel toward both ends, as is illustrated in FIG. 2.

The crown amount in the present disclosure is defined as (Do−DX2)/2. Here, Do and DX2 represent average values of diameters at respective arbitrary points.

In order to uniformly bring a main body of the roller into contact with the photosensitive member, when a length of the elastic body in the longitudinal direction is 220 mm or longer and 340 mm or shorter, the crown amount is preferably 0.01 mm or larger and 0.26 mm or smaller.

In addition, a suitable crown amount changes depending on a pressing load applied to both ends of the mandrel. For example, when 200 g or more and 500 g or less of pressure is applied to each of both the ends of the mandrel, the crown amount is preferably 0.15 mm or larger and 0.25 mm or smaller, and is more preferably 0.20 mm or larger and 0.25 mm or smaller, in order to enhance the uniformity of the pressure.

[Detailed Shape]

When the position of the end portion in the longitudinal direction of the elastic body is defined as X2, a position between the central position O and the X2 is defined as X1, a distance between the central position O and the X1 is defined as L1, and a distance between the X1 and the X2 is defined as L2, the L1 is defined as L1=0.6×(L1+L2). This means that a range from the central position O to the position X1 is a central region of the roller, and a range from the position X1 to the position X2 is an end region of the roller. Furthermore, the outer diameters at O, X1 and X2 are defined as Do, DX1 and DX2, respectively, and the following is defined:

$$Z1=(Do-DX1)/2, \text{ and}$$

$$Z2=(DX1-DX2)/2.$$

The Z1 is a decrement of a "radius at position X1" relative to a "radius at central position O" of the mandrel.

The Z2 is a decrement of a "radius at position X2" relative to a "radius at position X1".

Each of the Z1 and the Z2 is determined to be an arithmetic mean value of values calculated at 180 positions at a pitch of 1 degree in a circumferential direction of the roller.

Specifically, the first Z1 (hereinafter also referred to as Z1(1)) is calculated, and next, the second Z1 (hereinafter also referred to as Z1(2)) is calculated in such a state that the roller has been rotated by 1 degree in the circumferential direction;

and thus, calculation of Z1 every time the roller is rotated by 1 degree in the circumferential direction is repeated to one hundred eightieth Z1 (hereinafter also referred to as Z1(180)), and then an arithmetic mean value is calculated by dividing the total value from Z1(1) to Z1(180)(Z1(1)+Z1(2)+ . . . +Z1(180)), by 180.

An arithmetic mean value of Z2 is calculated in the same manner.

The electrophotographic roller in the present disclosure has a shape in which Z1, Z2, L1 and L2 satisfy the following calculation expression (1):

$$(Z2/L2)<\alpha\times(Z1/L1) \quad (1),$$

wherein $\alpha$ is 1.931.

The constant $\alpha$ represents a change rate of curvature in the central region and the end region of the roller.

Figure 3:
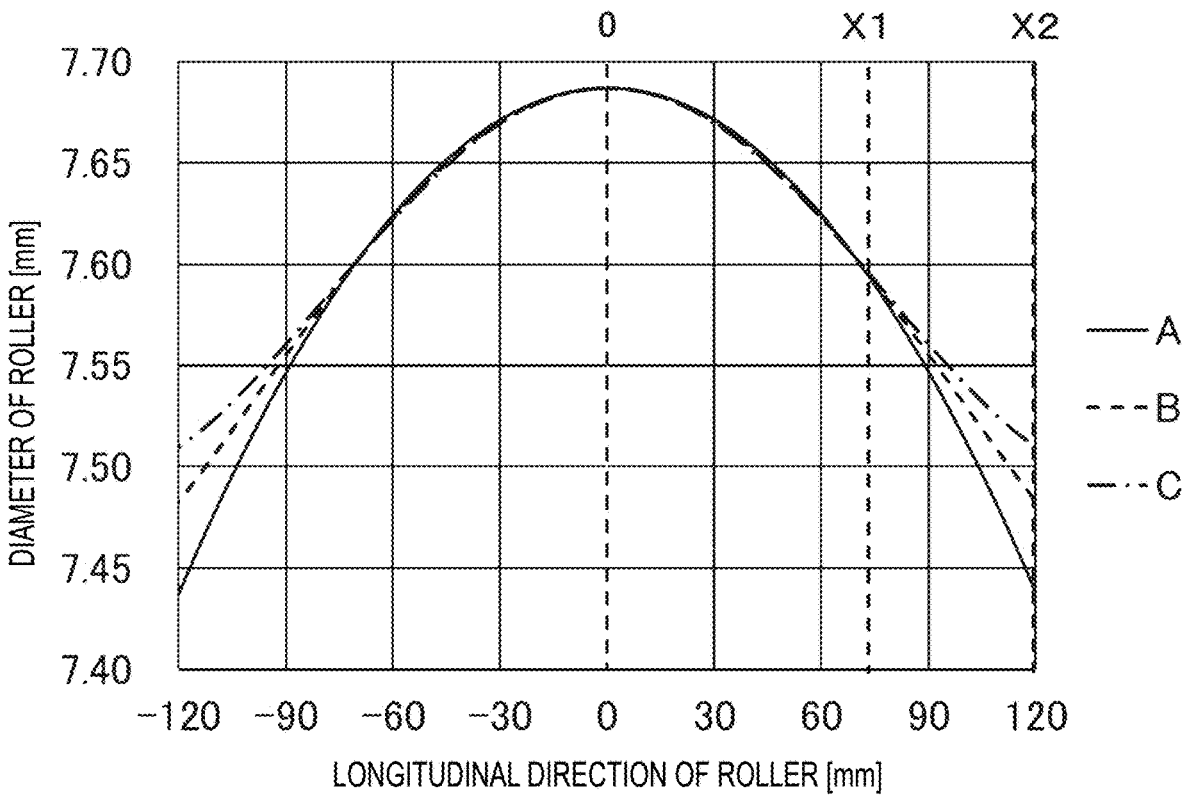
FIG. 3 illustrates a view illustrating a difference in a roller shape due to a difference in constant $\beta$.

FIG. 3 illustrates roller shapes in which the respective curvatures of the end regions are different. The shapes of rollers B and C according to one aspect of the present disclosure are indicated by a broken line and an alternate long and short dash line, respectively. In addition, the shape of a roller A having a general crown shape illustrated in FIG. 3 is illustrated by a solid line. Table 1 shows each of numerical values of Z1, L1, Z2 and L2 of the rollers A to C, and values of $\beta$, which are calculated from these numerical values with the use of the following calculation expression.

$$\beta=(Z2/L2)/(Z1/L1)$$

The lengths in the longitudinal direction of elastic layers 2 of the rollers have been set at 240 mm, and diameters thereof at the central position O have been set at 7.67 mm. FIG. 3 illustrates diameters at positions in the longitudinal direction of the rollers, respectively.

For information, when Y represents the diameter of the roller, and X represents a position in the longitudinal direction of the roller, a shape of a contour line of the elastic layer of the roller A which is indicated by the solid line in FIG. 3 is expressed as the following quadratic function of the X.

$Y=a(X-b)^2+c$ (wherein $a,b$ and $c$ *are* arbitrary constants)

In the roller A which has the general crown shape, the diameters in the end region (between the X1 and the X2) also gradually decrease, and the difference in the peripheral speed between the photosensitive member and the roller has been large in the end region. When an electrophotographic roller having the general crown shape such as the roller A is used as the charging roller, a large difference in the peripheral speed occurs between the photosensitive member and the electrophotographic roller (charging roller) in the end region. Then, due to the difference in the peripheral speed, the toner and the external additive which interpose between the photosensitive member and the electrophotographic roller are rubbed against the outer surface of the electrophotographic roller and stick thereto. Such a sticking matter causes abnormal discharge from the electrophotographic roller to the photosensitive member, and as a result, a spot (hereinafter, also referred to as "white spot") is formed in some cases, which should not be originally formed in an electrophotographic image. This phenomenon remarkably occurs, in particular, in such a low-temperature and low-humidity environment that the temperature is 15° C. and the relative humidity is 10%, for example.

Similarly, when the electrophotographic roller having the general crown shape like the roller A is used as the developing roller, a large difference in the peripheral speed occurs between the photosensitive member and the electrophotographic roller (developing roller), in the end region. Then, due to the difference in the peripheral speed, the toner which interposes between the photosensitive member and the electrophotographic roller is rubbed against the surface of the electrophotographic roller, and sticks thereto. Such a sticking matter reduces such a capability of the electrophotographic roller as to give an electric charge to the toner. As a result, the toner cannot be sufficiently charged on the developing roller. The toner having an insufficient amount of the electrostatic charge is transferred onto the surface of the photosensitive member, onto which the toner should not be transferred originally, and causes fogging in an electrophotographic image. This phenomenon occurs particularly remarkably in a high-temperature and high-humidity environment in which the temperature is 40° C. and the relative humidity is 95%, for example.

In contrast, in the roller B and the roller C according to the present disclosure, the curvature of the outer diameter of the end region is smaller than that of the central region. In other words, the radius of curvature is large. Thereby, in the central region, the nip width is more uniform in the longitudinal direction. In addition, in the end region, the difference in the peripheral speed from the photosensitive member is smaller than that of the roller A. Because of this, even when the roller B or the roller C is used as the charging roller and is applied to an image forming process which has been speeded up, the occurrence of the blot in the end region is slight compared to that of the roller A. In addition, even under a low-temperature and low-humidity environment, the occurrence of the white spot at the position corresponding to the end region of the electrophotographic image can be suppressed. In addition, also when the electrophotographic roller has been used as the developing roller, the electrophotographic roller can reduce or prevent the occurrence of the blot in the end region and suppress the occurrence of the fogging at a position corresponding to the end region of the electrophotographic image.

In FIG. 3, in the case of any $\beta$, the curvature of the central region is the same, and the contact stability of the central region is ensured. As previously described, the smaller the difference in the outer diameter in the longitudinal direction is, the smaller the difference in the peripheral speed in the end region is. Because of this, the roller C and the roller B are advantageous in this order (roller C is the most advantageous). On the other hand, when the $\beta$ value is small, there is a case where the contact pressure of the end portion becomes high, and thereby the blot adheres, though the outer diameter of the end portion becomes large and thereby the occurrence of the blot is improved which originates in the difference in the peripheral speed. Therefore, the constant $\beta$ needs to be controlled to be smaller than 1.931, for the purpose of uniformization of the contact pressure with respect to the photosensitive member, in addition to suppression for the blot which originates in the difference in the peripheral speed in the end region. In other words, it is necessary to control [(Z2/L2)/(Z1/L1)] to smaller than 1.931. In addition, it is preferably $1.000<[(Z2/L2)/(Z1/L1)]<1.931$. In addition, though an example has been shown in the above, in which the Z2 is changed while the Z1 is almost constant, the Z1 may be changed while the Z2 is almost constant; and even in this case, as long as the relationship of Expression (1) is satisfied, the blot in the end region, which originates in the difference in the peripheral speed, can be suppressed.

TABLE 1

| | Z1 (mm) | L1 (mm) | Z2 (mm) | L2 (mm) | β |
|---|---|---|---|---|---|
| Roller A | 0.0448 | 72.0 | 0.0797 | 48.0 | 2.669 |
| Roller B | 0.0446 | 72.0 | 0.0574 | 48.0 | 1.930 |
| Roller C | 0.0443 | 72.0 | 0.0442 | 48.0 | 1.497 |

[Method for Evaluating Difference in Peripheral Speed]

A magnitude of a vibration at the time when the electrophotographic roller rotates while following the photosensitive member is proportional to a magnitude of the difference in the peripheral speed of the electrophotographic roller with respect to the photosensitive member. By utilizing this property, the magnitude of the vibration is evaluated at the time when the electrophotographic roller is driven by the photosensitive member, and thereby the magnitude of the difference in the peripheral speed is evaluated.

The magnitude (amplitude) of the vibration of the electrophotographic roller can be measured with a laser Doppler vibrometer (trade name: LV-1710, manufactured by Ono Sokki Co., Ltd.). The measurement position is set at a position close to the center by 5 mm from the end portion of the elastic portion of the electrophotographic roller, and is a position opposite to the contact position with the photosensitive member (opposite side by 180 degree). The electrophotographic roller is incorporated into the electrophotographic process cartridge, and the vibration is measured at the time when the electrophotographic apparatus is operated. The amplitude is evaluated by subjecting the vibration of the electrophotographic apparatus to frequency analysis, and evaluating the frequency with the largest amplitude. The amplitude and the difference in the peripheral speed are proportional to each other, and accordingly, a smaller amplitude means a smaller difference in the peripheral speed; but, from the viewpoint of preventing the blot originating in the difference in the peripheral speed, the amplitude is preferably 12 nm or less.

[Method for Evaluating Fogging]

The amount of fogging by toner after endurance at the time when electrophotographic roller is incorporated as a developing roller can be measured by a reflection densitometer (trade name: TC-6DS/A; manufactured by Tokyo Denshoku Co., Ltd.). An electrophotographic roller is incorporated into an electrophotographic process cartridge as a developing roller, and 1000 sheets of paper are continuously passed. A reflectance R1 at a position 5 mm distant from the end portion in the 1000th image is measured by the reflection densitometer. In addition, a reflectance R0 of unprinted paper is also measured with the reflection densitometer.

Then, the amount of decrease in the reflectance "R0−R1" (%) with reference to unprinted paper is evaluated as a fogging value.

When the fogging value is 7% or smaller, it is determined that the influence of the lowering of the capability of giving the electric charge to the developing roller is small and the fogging does not occur.

<Method for Measuring Shape>

A non-contact type laser length measuring instrument can be used for the measurement of the outer diameter of the electrophotographic roller. As the non-contact type laser length measuring instrument, for example, there is a laser scan type of dimension/outer diameter measuring instrument "LS-5000" (trade name) manufactured by Keyence Corporation.

Figure 4A:
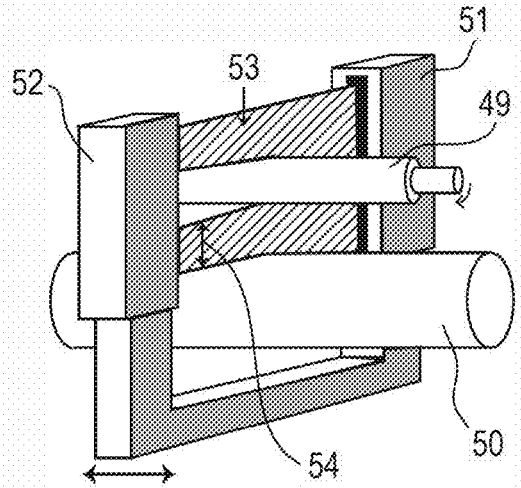
FIG. 4A and FIG. 4B illustrate views illustrating a method for measuring the shape of the electrophotographic roller.
Figure 4B:
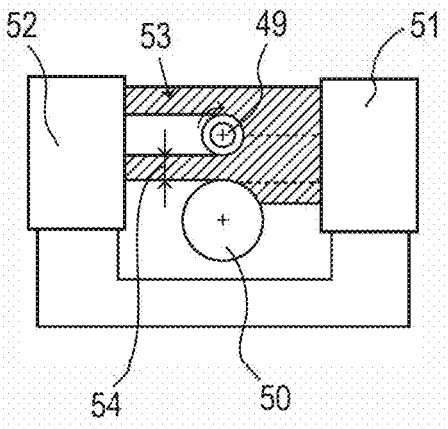

FIG. 4A and FIG. 4B illustrate a method of measuring an outer diameter with the use of the above laser scan type of dimension/outer diameter measuring instrument. FIG. 4A illustrates a perspective view of a state in which an electrophotographic roller 49 which is a measurement object and a reference roller 50 are placed on the measuring instrument, and FIG. 4B illustrates a side view thereof. A light receiving portion 52 receives a laser beam 53 (hatched portion) emitted from a laser light emitting portion 51. Firstly, the reference roller 50 is placed on the measuring instrument so that its axis and the laser beam 53 are orthogonal to each other. Next, the electrophotographic roller 49 as the measurement object is placed on the measuring instrument so as to be parallel to the axial line of the reference roller 50. In this state, a width 54 of the laser beam is measured which has been emitted from the laser emitting portion 51 and has transmitted between the reference roller 50 and the electrophotographic roller 49. The measurement pitch is preferably 2 mm or smaller in the longitudinal direction, and 5 degrees or smaller in the rotational direction, and is more preferably 1 mm pitch in the longitudinal direction and 1 degree pitch in the rotational direction. As illustrated in FIG. 2, at the time of specifying the position in the longitudinal direction of the measured shape data, when the central position of the electrophotographic roller 49 is denoted by O, the position of one end portion of the elastic portion is denoted by X2, and the distance from O to the X2 is denoted by L, the distance L1 from O to the X1 is determined to be L1=0.6×L. The distance between the X1 and the X2 is denoted by L2.

[Measurement of Diameter]

The diameter of the electrophotographic roller 49 is measured as a width of the laser which has been interrupted by the electroconductive base layer roller 49. Specifically, the diameter is measured every time the electrophotographic roller 49 is rotated, and the diameter of one circumference of the electrophotographic roller 49 is determined in one measurement cross section. The diameter in the present disclosure is defined as an average value of diameters of one circumference in each cross section. Next, the electrophotographic roller 49 is moved in the longitudinal direction, and a diameter is measured at another position in the longitudinal direction. In addition, the diameters at the central position O of the electrophotographic roller 49, X1 and X2 described previously are denoted by Do, DX1 and DX2, respectively, and Z1 and Z2 are calculated with the use of the following expressions:

$$Z1=(Do-DX1)/2, \text{ and}$$

$$Z2=(DX1-DX2)/2.$$

<Elastic Deformation Power>

[Elastic Deformation Power]

Subsequently, the elastic deformation power (hereinafter, also referred to as "ηIT") will be described.

Figure 5:
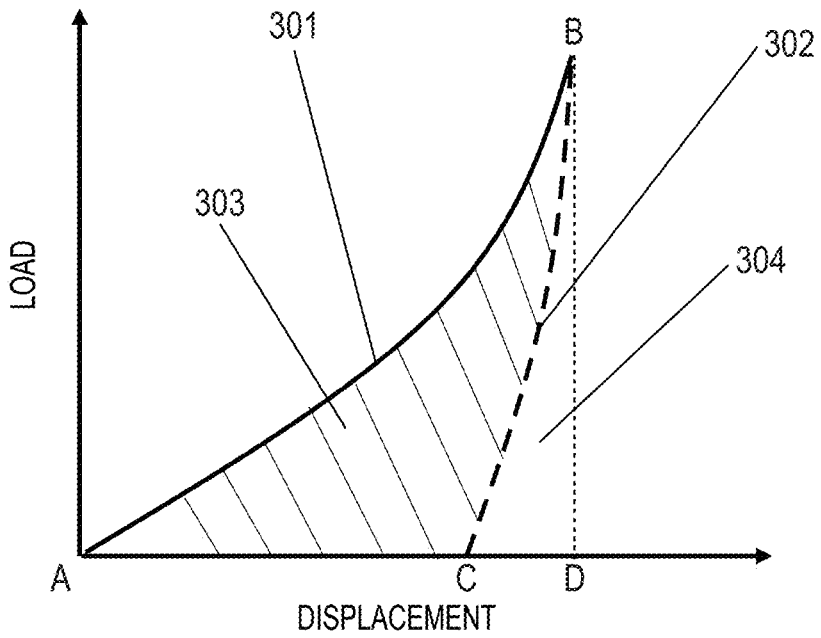
FIG. 5 illustrates a view illustrating a load-displacement curve for describing an elastic deformation power.

The ηIT can be calculated from a physical quantity that can be measured by measurement by the nanoindentation method (international standard: ISO14577). Detailed measurement conditions for the electrophotographic roller will be described in Example 1, and accordingly will be omitted here. FIG. 5 illustrates one example of a load-displacement curve required in a process of deriving the elastic deformation power. A load application curve 301 (curve from point A to point B) profiles a behavior of displacement with respect to a load, at the time when the load is applied to an object. A load-unloading curve 302 (curve from point B to point C) profiles a behavior of displacement with respect to the load, at the time when the load is unloaded from the object.

A work amount at the time when the load is applied (area of region 303 surrounded by load application curve 301, load-unloading curve 302 and straight line from point A to point C) is denoted by Wp (plastic deformation work amount). A work amount at the time when the load is unloaded (area of region 304 surrounded by load-unloading curve 302, straight line from point B to point D, and straight line from point C to point D) is denoted by We (elastic deformation work amount). The total work amount is denoted by Wt (total deformation work amount). The ηIT can be calculated with the use of We, Wt and the following expression:

$$Wt=Wp+We, \text{ and}$$

$$\eta IT(\%)=(We/Wt)\times 100.$$

In the case where the ηIT of the electrophotographic roller is high, it means that the electrophotographic roller has a high property of returning to an original state even if having been deformed, in other words, has a high elastic recovery rate. To the roller surface having high ηIT, even though a stress is applied thereto because of a pressure or the difference in the peripheral speed, in a state in which a blot such as the toner or the external additive such as a toner shell or silica adheres to the roller surface, the toner or the external additive resists sticking, because the elastic recovery rate of the roller is high. Because of this, the roller surface having the high ηIT is more advantageous for preventing the adhesion of the blot to the end region.

Figure 6A:
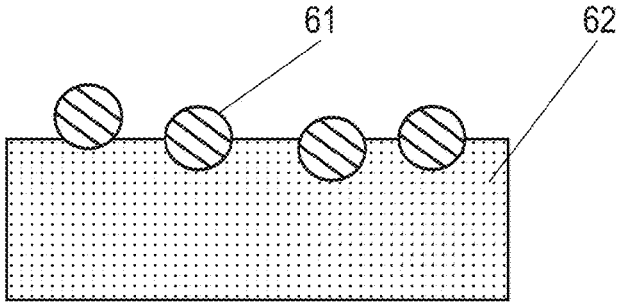
FIG. 6A and FIG. 6B illustrate views for describing a blotted state when the elastic deformation powers of the electrophotographic roller are different.
Figure 6B:
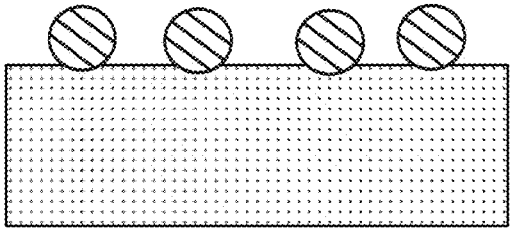

FIG. 6A and FIG. 6B schematically illustrate a state at the time when an electrophotographic roller is incorporated as a charging roller into an electrophotographic apparatus, the endurance of 1,000 sheets has been evaluated, then the electrophotographic roller has been removed and cut, and the cross section has been observed. FIG. 6A illustrates a case where the ηIT is 40%, and FIG. 6B illustrates a case where the ηIT is 55%. Detailed endurance conditions will be described in Example 1.

As is illustrated in FIG. 6A, when the ηIT is 40, the shell of the toner and the blot 61 of the external additive are buried in the elastic layer 62. On the other hand, as illustrated in FIG. 6B, when the ηIT is 56, the shell of the toner and the blot 61 of the external additive are not buried in the elastic layer 62, and resist causing an image defect compared to the case where the ηIT is 40. In the present disclosure, the ηIT is set to 56% or larger, which is effective for suppressing the burying of the blot of the external additive into the charging roller, but is preferably 65% or larger for the purpose of more effectively suppressing the burying, and is more preferably 75% or larger from the same viewpoint.

In order to enhance the ηIT of the charging roller, it is necessary to promote crosslinking only in the vicinity of the surface of the elastic layer, while the hardness of the inside of the elastic layer is kept at an appropriate crosslinking density. As a specific method for promoting the crosslinking in the vicinity of the surface of the elastic layer, there is electron beam irradiation (hereinafter also referred to as "EB treatment"), for example. By the EB treatment being performed, only the outermost surface of the charging roller can be crosslinked while the crosslinking density inside the elastic layer is kept. Further, the EB treatment can easily enhance the ηIT by changing the intensity of the electron beam irradiation. In the above, the units for enhancing the ηIT have been described, but the units for increasing the ηIT are not limited to these techniques.

<Electrophotographic Roller>

Figure 1:
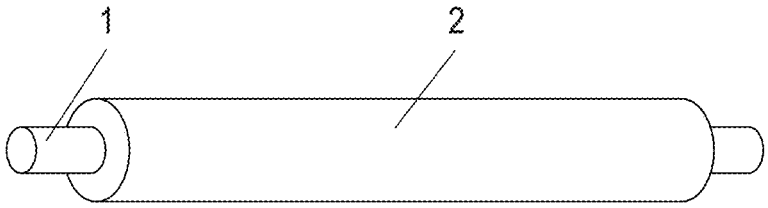
FIG. 1 illustrates an external view of an electrophotographic roller.

FIG. 1 schematically illustrates an external view of the electrophotographic roller. The electrophotographic roller has a structure having an elastic layer 2 on the outer circumference of a mandrel 1, in which both ends of the mandrel 1 are exposed without being covered with the elastic layer 2. The charging roller is provided in an electrophotographic image forming apparatus, as a charging unit that electrically charges the photosensitive member. Specifically, the charging roller is brought into contact with the photosensitive drum, is driven by the photosensitive member of the photosensitive drum, and is charged by friction at a contact portion between the photosensitive drum and the charging roller. In addition, the developing roller is provided as a unit for stably supplying the toner to the photosensitive member.

[Mandrel]

The mandrel 1 that is used in the elastic roller of the present disclosure has electroconductivity, and has a function of supporting the elastic layer or the like, which is provided on the outer circumference thereof. Examples of the material include metals such as iron, copper, stainless steel, aluminum and nickel, and alloys thereof. In addition, these materials may be subjected to plating treatment or the like, in order that these surfaces are imparted with scratch resistance. Furthermore, as the mandrel, a mandrel can also be used that is a substrate formed from a resin, of which the surface is coated with a metal or the like and imparted with surface electroconductivity, or a mandrel can also be used that is produced from an electroconductive resin composition.

In addition, an adhesive layer (unillustrated) may be provided between the mandrel 1 and the elastic layer 2. In this case, it is preferable that the adhesive is electroconductive. In order to impart the electroconductivity, appropriate agents are selected from known electroconductivity imparting agent (for example, ion conductivity imparting agent and electron conductivity imparting agent), and can be used alone or in combination of two or more thereof, for the adhesive.

Examples of the binder of the adhesive include thermosetting resins and thermoplastic resins, and known binders can be used such as urethane-based, acrylic-based, polyester-based, polyether-based and epoxy-based binders. Examples of the adhesive include METALOC N33 (epoxy-based adhesive having electroconductivity, produced by Toyokagaku Kenkyusho Co., Ltd.). As a coating method of the adhesive, known methods can be used such as a roll coater, sponge coating and spray coating.

The adhesive layer between the mandrel 1 and the elastic layer 2 may be provided over the whole face at which the mandrel 1 and the elastic layer 2 come in contact with each other, or may be provided only in the range of from 5 mm to 20 mm by width at both end portions of the face at which the mandrel 1 and the elastic layer 2 come in contact with each other. The thickness of the adhesive layer is preferably 1 μm to 10 μm.

[Elastic Layer]

The elastic layer 2 provided on the outer circumferential surface of the mandrel 1 may be a solid body or a foamed body, and may be a single layer or may be formed of a plurality of layers.

It is preferable that a hardness of the elastic layer 2 is 10 degrees or higher and 70 degrees or lower by an Asker C hardness. When the Asker C hardness of the elastic layer 2 is 10 degrees or higher, exudation of an oil component from a rubber material constituting the elastic layer 2 can be easily suppressed, and contamination of a contact member such as a photosensitive drum can be suppressed. In addition, when the Asker C hardness of the elastic layer 2 is 70 degrees or lower, the contact of the elastic roller with the contact member becomes stable, and deterioration in an image quality of the output image can be suppressed. Here, the Asker C hardness can be defined by a measurement value that is measured by an Asker Rubber hardness meter (manufactured by Kobunshi Keiki Co., Ltd.) with the use of a test piece which has been separately prepared according to the standard specification Asker C type SRIS (The society of Rubber Industry, Japan standard) 0101.

[Material for Forming Elastic Layer]

The material for forming the elastic layer contains a binder resin and an electroconductive particle.

Examples of the binder resin include the following. Rubbers and thermoplastic elastomers including: natural rubber, butadiene rubber, styrene-butadiene rubber (SBR), nitrile rubber, ethylene propylene rubber (EPDM), chloroprene rubber (CR), acrylonitrile butadiene rubber (NBR), epichlorohydrin rubber, butyl rubber, silicone rubber, urethane rubber, fluorine rubber and chlorine rubber. Among the substances, NBR can be suitably used from the viewpoint of compression permanent set and the hardness. Furthermore, among the NBRs, an NBR is preferable which has a nitrile content of 30% or more and less than 36%, and is referred to as a so-called medium-high nitrile. As such a medium-high nitrile, a nitrile commercially available as "N230SV" (trade name, manufactured by JSR Corporation) can be used, for example.

As the electroconductive particle, electroconductive carbons can be used such as Ketjen Black EC, acetylene black, carbon for rubber, carbon for color (ink) subjected to oxidation treatment, and pyrolytic carbon. Specific examples of the carbon for rubber include the following carbons for rubber. Super Abrasion Furnace (SAF: super abrasion resistance), Intermediate Super Abrasion Furnace (ISAF: intermediate super abrasion resistance), High Abrasion Furnace (HAF: high abrasion resistance), Fast Extruding Furnace (FEF: adequate extrudability), General Purpose Furnace (GPF: general purpose), Semi Reinforcing Furnace (SRF: medium reinforcement), Fine Thermal (FT: fine particle thermal decomposition), and Medium Thermal (MT: medium particle thermal decomposition). In addition, graphite can also be used such as natural graphite and artificial graphite.

Examples of the usable electroconductive particle include: particles of metallic oxides such as $TiO_2$, $SnO_2$ and ZnO; particles of composite oxides such as solid solutions of ZnO and $Al_2O_3$; powders of metals such as Cu and Ag; and various known particles. The particles may be used alone, or a blend of two or more types thereof may be used.

[Roughening Particle]

To the material for forming the elastic layer, a spherical particle may be added which has a particle diameter, for example, in a range of 1 μm to 90 μm. Examples of the spherical particle include at least one spherical particle selected from the following particles:

a phenol resin particle, a silicone resin particle, a polyacrylonitrile resin particle, a polystyrene resin particle, a polyurethane resin particle, a nylon resin particle, a polyethylene resin particle, a polypropylene resin particle, an acrylic resin particle, a silica particle, and an alumina particle. Due to the use of such a rubber composition, a charging roller can be produced in which the outer surface of the elastic layer has projecting portions derived from the spherical particle.

[Other Additives]

In addition, if necessary, a vulcanizing agent, a vulcanization accelerator, an electroconductivity imparting agent, a charge control agent, a plasticizer, an anti-aging agent and the like can be appropriately added. In addition, an antistatic agent, an ultraviolet absorber, a reinforcing agent, a filler, a lubricant, a mold release agent, a pigment, a dye, a flame retardant and the like can be appropriately added, as needed.

<Method for Manufacturing Electrophotographic Roller>

[Step of Manufacturing Precursor of Electrophotographic Roller]

As a method for manufacturing the electrophotographic roller according to one aspect of the present disclosure, there is a method of coating the mandrel with the material for forming the elastic layer, with the use of an extrusion machine having a crosshead, for example.

Figure 7:
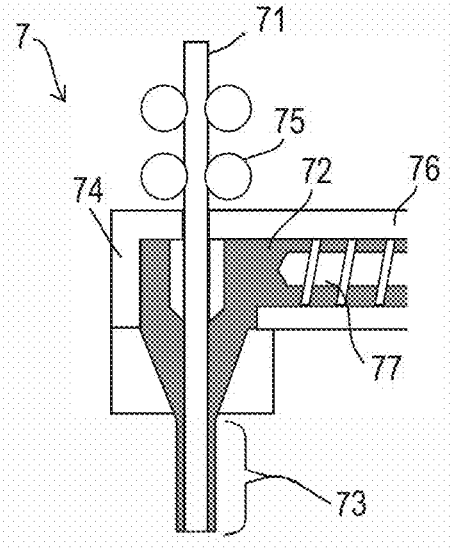
FIG. 7 illustrates a view illustrating a schematic configuration of a crosshead extrusion apparatus.

FIG. 7 is an explanatory view of a process of forming a layer of the material for forming the elastic layer on the outer circumferential surface of the mandrel, by co-extruding the mandrel and the material for forming the elastic layer with the use of an extrusion molding machine 7 provided with a crosshead 74.

The extrusion molding machine 7 is provided with the crosshead 74 into which the mandrel 71 and the material 72 for forming the elastic layer are fed, a feed roller 75 which feeds the mandrel 71 into the crosshead 74, and a cylinder 76 which feeds the material 72 for forming the elastic layer into the crosshead 74.

The material 72 for forming the elastic layer is fed into the crosshead 74 by a screw 77 in a cylinder 76, and at the same time, the mandrel 71 is fed into the crosshead 74; and thereby, the mandrel 71 having the layer of the material for forming the elastic layer is discharged from the crosshead, which is formed on the outer circumferential surface. Hereinafter, the mandrel which has the layer of the material for forming the elastic layer formed on the outer circumferential surface is also referred to as a "coated roller 73".

The outer diameter of the electrophotographic roller according to one aspect of the present disclosure can be controlled by changing a relative ratio between the feed speed of the mandrel 71 to the crosshead by the feed roller 75 and the feed speed of the material for forming the elastic layer from the cylinder 76. For example, the thickness of the elastic layer in the longitudinal direction of the mandrel can be adjusted by keeping the feed speed of the material for forming the elastic layer from the cylinder to the crosshead constant, and changing the feed speed of the mandrel 71 to the crosshead. Specifically, by enhancing the feed speed of the mandrel, the thickness of the elastic layer can be relatively thinned, in other words, the diameter can be reduced. Here, in order to adjust the thickness of the elastic layer more accurately in the longitudinal direction of the mandrel, in other words, the diameter of the electrophotographic roller, it is preferable to use a manufacturing method having the following four steps.

(First step) A step of obtaining a relationship between the feed speed of the mandrel to the crosshead and the thickness of the layer of the material for forming the elastic layer, which is formed on the mandrel, by performing preforming of keeping the feed speed of the material for forming the elastic layer to the crosshead constant, and changing the feed speed of the mandrel to the crosshead;

(second step) a step of measuring an outer diameter of the coated roller which has been extruded from the crosshead;

(third step) a step of determining a feed speed of the mandrel for forming the crown shape, based on the measured value of the outer diameter obtained in the second step, in light of the information obtained in the first step; and (fourth step) a step of controlling a rotation speed of the feed roller 75, based on the feed speed of the mandrel, which has been determined in the third step.

The third and fourth steps will be specifically described below.

When it is determined that the measured value of the thickness of the layer of the material for forming the elastic layer is large at a predetermined position in the longitudinal direction of the mandrel, compared with the target crown shape, the rotation speed of the feed roller 75 is increased to increase the feed speed of the mandrel, and thereby the outer diameter becomes small. On the other hand, when it is determined that the thickness is small, the rotation speed of the feed roller 75 is decreased to decrease the feed speed of the mandrel, and thereby the outer diameter becomes large. This feedback control is performed at intervals of, for example, 0.01 seconds, and thereby the outer shape of the elastic layer can be controlled to the target crown shape with high accuracy, without grinding.

For information, when the crown-shaped electrophotographic roller according to the present disclosure is obtained by the above method, it is preferable to determine the target shape at the time of extrusion molding, considering that there is a case where the elastic layer shrinks in the subsequent vulcanizing step.

In addition to the above method, there is a method of using a mold having a cavity shape corresponding to the crown shape according to one aspect of the present disclosure, filling the cavity around the mandrel arranged in the mold with the material for forming the elastic layer, and curing the material.

In addition, when the crosshead is used, the electrophotographic roller can also be manufactured by operations of: producing a coated roller having an outer diameter equal to the outer diameter of the thickest central portion of the target crown shape or larger than the outer diameter of the thickest central portion, while keeping the feed speed of the mandrel to the crosshead and the feed speed of the material for forming the elastic layer constant; and grinding the outer circumferential surface of the rubber layer obtained by curing the layer of the material for forming the elastic layer, with the use of a grindstone or the like.

[Vulcanization Step and Cut-Off Step]

The molded electrophotographic roller precursor is heated and vulcanized by units of a hot air oven, a vulcanizing can, a hot plate, far-near infrared rays, induction heating and the like. The heating temperature varies depending on the material for forming the elastic layer, but is preferably 130 to 250° C., and is more preferably 140 to 220° C.; and the heating time is preferably 5 to 240 minutes, and is more preferably 10 to 60 minutes.

A vulcanized rubber composition at both end portions of the vulcanized rubber roller is removed in a later separate step, and the electrophotographic roller is completed. Accordingly, both end portions of the core metal are exposed in the completed electrophotographic roller.

[Surface Treatment Step]

The surface layer may be subjected to surface treatment such as ultraviolet irradiation for the purpose of reducing a friction coefficient of the surface, or electron beam irradiation for the purpose of enhancing the ηIT.

<Process Cartridge>

Figure 8:
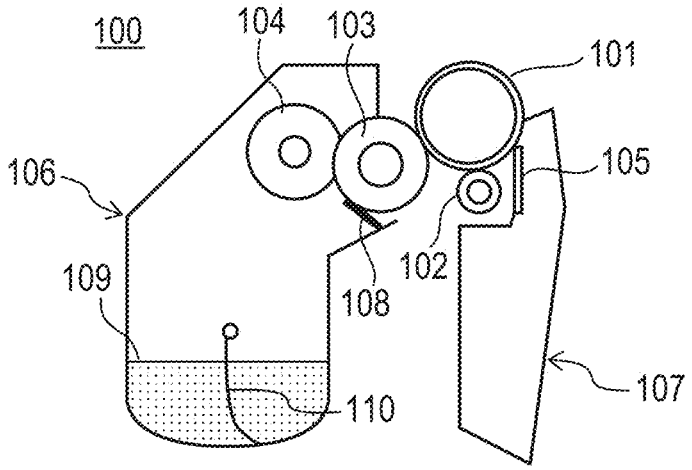
FIG. 8 illustrates a cross-sectional view of a process cartridge according to one embodiment of the present disclosure.

FIG. 8 illustrates one example of a process cartridge for electrophotography, which is provided with a charging roller according to one embodiment of the present disclosure. The process cartridge 100 illustrated in FIG. 8 is configured so that a developing apparatus and a charging apparatus are integrated, and so as to be detachably attachable to a main body of an electrophotographic apparatus.

The developing apparatus is formed by integrating at least a developing roller 103, a toner container 106, and a toner 109. The photosensitive drum 101 is one example of an electrophotographic photosensitive member. The developing apparatus may include a toner supply roller 104, a developing blade 108, and a stirring vane 110, as needed.

The charging apparatus is formed by integrating at least the photosensitive drum 101 and a charging roller 102. The charging roller 102 is arranged at a position at which the photosensitive drum 101 can be electrically charged. The charging apparatus may be provided with a cleaning blade 105 and a waste toner container 107. The charging roller 102, the developing roller 103, the toner supply roller 104 and the developing blade 108 are configured so that voltages are applied thereto, respectively.

<Electrophotographic Apparatus>

Figure 9:
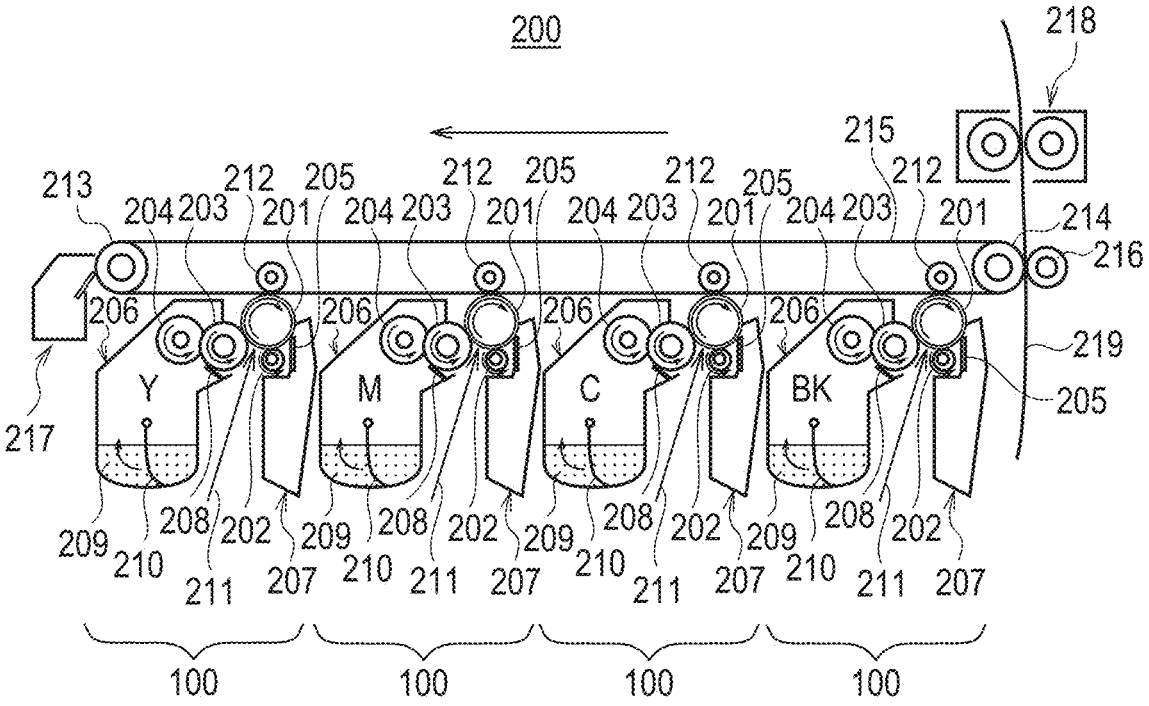
FIG. 9 illustrates a cross-sectional view of an electrophotographic apparatus according to one embodiment of the present disclosure.

FIG. 9 illustrates a view illustrating one example of the electrophotographic apparatus that uses the charging roller according to one embodiment of the present disclosure. The electrophotographic apparatus 200 illustrated in FIG. 9 is configured so that four process cartridges 100 are detachably attached thereto. Each process cartridge 100 corresponds to each color of black, magenta, yellow and cyan, and toners corresponding to the respective colors are used. Each process cartridge 100 has the same configuration except that the color of the toner to be used is different.

Each process cartridge 100 has basically the same configuration as that illustrated in FIG. 8. The process cartridge 100 includes a photosensitive drum 201, a charging roller 202, a developing roller 203, a toner supply roller 204, a cleaning blade 205, a toner container 206, a waste toner storage container 207, a developing blade 208, a toner 209, and a stirring vane 210.

The photosensitive drum 201 rotates in an arrow direction (clockwise direction), and is uniformly charged by the charging roller 202 to which a voltage is applied from a charging bias power source. When the surface of the photosensitive drum 201 is irradiated with an exposure light 211, an electrostatic latent image is formed on the surface.

On the other hand, the toner 209 stored in the toner container 206 is supplied to the toner supply roller 204 by the stirring vane 210. The toner supply roller 204 supplies the toner 209 to the developing roller 203. The surface of the developing roller 203 is uniformly coated with the toner 209 by the developing blade 208 which is arranged in contact with the developing roller 203, and a electric charge is given to the toner 209 by frictional charging.

The above electrostatic latent image is developed by being imparted with the toner 209 that is conveyed by the developing roller 203 which is arranged in contact with the photosensitive drum 201, and is visualized as a toner image.

The visualized toner image on the photosensitive drum is transferred onto an intermediate transfer belt 215 by a primary transfer roller 212 to which a voltage is applied by a primary transfer bias power source. The intermediate transfer belt 215 is supported and driven by a tension roller 213 and an intermediate transfer belt drive roller 214. The toner images of the respective colors are sequentially superimposed to form a color image on the intermediate transfer belt 215.

A transfer material 219 is fed into the apparatus by a sheet feeding roller. The transfer material 219 is conveyed to between the intermediate transfer belt 215 and a secondary transfer roller 216. A voltage is applied to the secondary transfer roller 216 from a secondary transfer bias power source, and the color image on the intermediate transfer belt 215 is transferred to the transfer material 219. The transfer material 219 to which the color image has been transferred is subjected to a fixing process by a fixing device 218. The transfer material 219 that has been subjected to the fixing process is discharged to the outside of the apparatus.

On the other hand, the toner which has remained on the photosensitive drum 201 without being transferred is scraped off by the cleaning blade 205 and is stored in a waste toner storage container 207. In addition, the toner which has remained on the intermediate transfer belt 215 without being transferred is also scraped off by a cleaning apparatus 217.

According to one aspect of the present disclosure, an electrophotographic roller can be obtained that can suppress the adhesion of the blots in the end region of the electrophotographic roller, even in a high-speed electrophotographic apparatus. In addition, according to another aspect of the present disclosure, a process cartridge can be obtained that contributes to stable formation of a high-quality electrophotographic image. According to further another aspect of the present disclosure, an electrophotographic image forming apparatus can be obtained that can stably form a high-quality electrophotographic image.

EXAMPLES

The present disclosure will be described below in detail with reference to Examples, but the present disclosure is not limited to Examples.

Example 1

Preparation of Unvulcanized Rubber Composition for Elastic Layer

An A-kneaded rubber composition was obtained by mixing the materials shown in the following Table 2. As a mixing machine, a 6-liter pressure kneader (product name: TD6-15MDX, manufactured by Toshin Co., Ltd.) was used. Mixing conditions were set at a filling rate of 70 vol %, a blade rotation speed of 30 rpm, and a period of 16 minutes.

TABLE 2

| Material | Parts by mass |
|---|---|
| NBR<br>(Trade name: JSR N230SV, produced by JSR Corporation) | 100 |
| Zinc stearate | 1 |
| Zinc oxide | 5 |
| Calcium carbonate<br>(Trade name: Super #1700, produced by Maruo Calcium Co., Ltd.) | 25 |
| Carbon Black<br>(Trade name: TOKABLACK #7270SB, produced by Tokai Carbon Co., Ltd.) | 50 |

Next, an unvulcanized rubber composition 1 was obtained by mixing materials shown in the following Table 3. As a mixing machine, an open roll (product name: 12×30 test roll, manufactured by Kansai Roll Co., Ltd.) was used which had a roll diameter of 12 inches (0.30 m). As for the mixing conditions, the number of rotations of the front roll was set at 10 rpm, the number of rotations of the rear roll was set at 8 rpm, and the roll gap was set at 2 mm; left and right were turned back 20 times in total; and then the roll gap was set at 0.5 mm, and tight milling was performed 10 times.

TABLE 3

| Material | Parts by mass |
|---|---|
| A-kneaded rubber composition | 181 |
| Sulfur | 1 |
| Vulcanization accelerator<br>(Trade name: Nocceller TBzTD; produced by Ouchi Shinko Chemical Industrial Co., Ltd.) | 3 |

<Production of Electrophotographic Roller>

As the mandrel, a stainless-steel rod was prepared which had a diameter of 4.975 mm and a length of 250 mm. In order to form the unvulcanized rubber composition 1 around the mandrel, an extrusion forming apparatus (manufactured by Mitsuba Mfg. Co., Ltd.) was used which had the crosshead shown in FIG. 7. As an extrusion machine of the extrusion molding apparatus, an extrusion machine provided with a degassing port was used in which an inner diameter of the cylinder was 70 mm and a ratio of the length to the diameter of the cylinder was 20.

An extrusion molding temperature was set at 100° C. for each of the cylinder, a screw and a crosshead die. The number of rotations of the screw was set at 10 rotations per minute. These conditions were adopted, and the mandrel was coated with the unvulcanized rubber composition 1.

For information, when the mandrel is coated, the feed speed of the feed roll was controlled and the wall thickness was adjusted so that the shape of the charging roller became a crown shape after the electrophotographic roller precursor was vulcanized and the end portion of the elastic layer was removed, and in addition, the shape of the electrophotographic roller after the end portion of the elastic layer was removed showed that the values of L1, L2, Z1 and Z2 illustrated in FIG. 2 were the respective values shown in Table 4; and the electrophotographic roller precursor was formed.

Specifically, an inflow speed of the material for forming the elastic layer into the crosshead was kept constant at $5.20\times10^{-4}$ $mm^3$/second; and on the other hand, when the layer of the material for forming the elastic layer was formed, and the central portion in the longitudinal direction of the mandrel was formed, the feed speed of the mandrel to the crosshead was set at 4.70 mm/second, and when both of the end portions were formed, the feed speed of the mandrel to the crosshead was set at 5.80 mm/sec.

In addition, the thickness (diameter) of the layer of the material for forming the elastic layer around the mandrel immediately after having been extruded from the crosshead was measured with the use of a laser measuring device, and feedback control of the feed speed of the mandrel was performed, based on the relationship between the feed speed and the diameter of the mandrel acquired in advance in the preforming.

The obtained electrophotographic roller precursor was heated in a hot air oven at 160° C. for 1 hour, and then both of the end portions of the layer of the material for forming the elastic layer in the electrophotographic roller precursor were removed by 10 mm; and an electrophotographic roller 1 was obtained. The length of the elastic layers in the longitudinal direction of the electrophotographic roller 1 was 230 mm; and L1 was 69 mm and L2 was 46 mm.

<Surface Treatment>

The surface of the obtained electrophotographic roller was irradiated with ultraviolet rays, and an electrophotographic roller 1' was obtained which had UV-treated region on the surface of the elastic layer. A low-pressure mercury-vapor lamp (trade name: GLQ500US/11, manufactured by Toshiba Lighting & Technology Corporation Co., Ltd.) was used for the irradiation of ultraviolet rays, and the electrophotographic roller was uniformly irradiated while having been rotated at a constant speed while the mandrel 1 was regarded as a rotational axis. The amount of the ultraviolet rays was set so as to be 9000 mJ/cm$^2$ in terms of the sensitivity of the sensor for 254 nm.

<Measurement of Outer Diameter of Electrophotographic Roller>

The outer diameter of the electrophotographic roller 1' was measured with the use of a non-contact laser measuring instrument, according to a configuration illustrated in FIG. 4A and FIG. 4B. In the present Example, the shape of the roller was measured with the use of a non-contact laser measuring instrument (LS-5000; manufactured by Keyence Corporation), by the operation of moving the roller at a 1 mm pitch in the longitudinal direction and at a pitch of 1 degree in the rotational direction.

The diameter in the present disclosure is defined as an average value of diameters of one circumference in each cross section. The diameters at the central position O, X1 and X2 of the charging roller 1' in FIG. 2 were defined as Do, DX1 and DX2, respectively, and Z1 and Z2 were defined as Z1=(Do−DX1)/2 and Z2=(DX1−DX2)/2; and each value was calculated. As a result of calculation, Do was 7.69 mm, and Z1 and Z2 became as shown in Table 4.

<Measurement of ηIT>

An indentation test was performed on the produced electrophotographic roller 1' according to a method according to ISO 145177, with the use of a nanoindentation apparatus (apparatus name: PICODENTOR, model number: HM500, manufactured by Fischer Instruments K. K.), and the ηIT was analyzed.

As for a measurement condition, an approach speed of an indenter was 100 nm/s; as for a load condition, the maximum load was 1 mN, and an indentation time was 3 s; and an unloading condition was the reverse of the load condition.

The measurement points were 36 points in total of 12 points at intervals of 30 degrees in the circumferential direction, for three points in total of the central position in the longitudinal direction of the electrophotographic roller and two positions close to the center by 10.0 mm from both end portions of the elastic layer, and measurement was performed there.

The test was performed under the above conditions to obtain a load-displacement curve of the electrophotographic roller 1', and the ηIT was calculated for each curve. In the present disclosure, the median value of ηITs at 36 points is denoted by the ηIT.

As a result, in the present Example, the ηIT was 45 [%] as shown in Table 6.

<Measurement of Amplitude and Evaluation of Difference in Peripheral Speed>

The electrophotographic roller 1' is incorporated into the process cartridge as a charging roller, the vibration of the charging roller is measured at the time when an electrophotographic apparatus is operated, and a magnitude of the amplitude is evaluated as a magnitude of the difference in the peripheral speed. As a measuring instrument, a laser Doppler vibrometer (trade name: LV-1710, manufactured by Ono Sokki Co., Ltd.) was used. The measurement position was set at a position close to the center by 5 mm from the end portion of the elastic portion of the electrophotographic roller, on a position opposite to the contact position with the photosensitive member (position on the opposite side by 180 degree). As an electrophotographic apparatus for measurement of the amplitude, Laserjet M608dn (manufactured by HP Inc.) was prepared, and was used after having been modified so that the number of output sheets per unit time became 75 sheets/min (A4 vertical output), which was larger than the original number of output sheets, in order to perform evaluation in a high-speed process. An electrophotographic process cartridge for the above printer was used as the electrophotographic process cartridge. Vibrations were measured at the time when the printer was operated, and the frequencies were analyzed; as a result, the amplitude was large at a frequency of 2700 Hz; and the magnitude of the amplitude at the frequency of 2700 Hz was adopted as the magnitude of the vibration of the charging roller 1. The measurement results are shown in Table 6.

<Image Evaluation and Observation of Blot on Charging Roller>

The electrophotographic roller 1' was incorporated into an electrophotographic apparatus as a charging roller, and was subjected to a paper passing endurance test under a low-temperature and low-humidity environment. As the electrophotographic apparatus, a laser printer (trade name: Laserjet M608dn; manufactured by HP Inc.) was prepared. The laser printer was used after having been modified so that the number of output sheets per unit time became 75 sheets/min (A4 vertical output), which was larger than the original number of output sheets, in order to perform evaluation in a high-speed process. The resolution of an image of the above laser printer is 600 dpi, and the output of primary charging is a DC voltage of −1100V. An electrophotographic process cartridge for the above printer was used as the electrophotographic process cartridge. For information, the electrophotographic process cartridge includes a drum-shaped electrophotographic photosensitive member and a charging roller which is arranged in contact with the electrophotographic photosensitive member. In addition, a pressure of 250 g is applied to each of both ends of the mandrel body of the charging roller, and thereby the charging roller is pressed against the electrophotographic photosensitive member.

Firstly, the electrophotographic roller 1', the electrophotographic apparatus and the process cartridge were left to stand in an environment at a temperature of 15° C. and a relative atmospheric humidity of 10% for 48 hours, for the purpose of being acclimated to the measurement environment.

Subsequently, the electrophotographic roller 1' was incorporated into the process cartridge as a charging roller. The output image was evaluated with the use of the process cartridge.

Specifically, an E character image having a print density of 1% was subjected to the endurance (image output) of continuous 1000 sheets, under a low-temperature and low-humidity environment (temperature of 15° C., and relative humidity of 10%). After 1000 sheets of images were output, a halftone image (image in which horizontal lines each having width of 1 dot in direction perpendicular to rotation direction of electrophotographic photosensitive member and interval of 2 dots were drawn) was output. The obtained image was visually observed, and an image defect was observed which originates in the adhesion of the blot on the surface of the charging roller.

After the image for the evaluation was output, the degree of the adhesion of the blots of the toner and external additives on the surface of the electrophotographic roller 1' was observed, with a digital microscope (model number VH-8000, manufactured by Keyence Corporation). As for the observation positions, two positions were observed which were sides by 10 mm inner from the end portions of the elastic layer, respectively, and a position at which the adhesion state of the blot was inferior was determined to be places to be evaluated.

The results of the observation of the image defects originating in the adhesion of the blot on the halftone image and the results of microscopic observation of the surface of the electrophotographic roller 1' were evaluated according to the criteria shown in Table 5. The results are shown in Table 6.

Example 2

An electrophotographic roller 1' was obtained in the same manner as in Example 1, except that the numerical values of Z1, Z2 and (Do−DX2)/2 were controlled as shown in Table 4.

The obtained electrophotographic roller 1' was evaluated in the same manner as in Example 1. The results are shown in Table 6.

Examples 3 to 6

Electrophotographic rollers 1' were obtained in the same manner as in Example 1, except that the numerical values of Z1, Z2 and (Do−DX2)/2 were controlled as shown in Table 4.

For the measurement of the amplitudes of the obtained electrophotographic rollers 1', the evaluation of the image, and the observation of the blot of the charging roller, Laserjet M608dn (manufactured by HP Inc.) was prepared as an electrophotographic apparatus, was modified so that the number of output sheets per unit time became 100 sheets/min (A4 vertical output), which was larger than the original number of output sheets, in order to perform the evaluation in a high-speed process, and was used.

Example 7

The surface of the obtained electrophotographic roller was irradiated with an electronic beam, and an electrophotographic roller was obtained which had EB-treated region on the surface of the elastic layer. For the electron-beam irradiation, an electron-beam irradiation apparatus having a maximum acceleration voltage of 70 kV (trade name: "low-energy electron-beam irradiation source EB-ENGINE" manufactured by Hamamatsu Photonics K.K.) was used. For information, before the electron beam irradiation, the air in the irradiation chamber was purged with nitrogen gas, and the oxygen concentration in the irradiation chamber was adjusted. The treatment conditions were as follows: acceleration voltage: 70 kV, electronic current (irradiation current): 1.5 mA, treatment speed (scanning speed): 0.6 m/min, and concentration of oxygen: 800 ppm. At this time, the apparatus constant at the acceleration voltage of 70 kV in the electron-beam irradiation apparatus was 218, and the dose calculated by Expression (1) was 1635 kGy.

$$D=(K\cdot I)/V \quad (1)$$

An electrophotographic roller 1" shown in Table 4 was obtained in the same manner as in Example 1, except for the above. The obtained electrophotographic roller 1" was evaluated in the same manner as in Example 1. The evaluation results are shown in Table 6.

Example 8

An electrophotographic roller 1" having an EB-treated region on the surface of the elastic layer was obtained in the same manner as in Example 1, except that among the conditions of the electron-beam irradiation in Example 7, an electronic current was set at 3.0 mA and the electron-beam irradiation was performed. Z1, Z2 and the like are shown in Table 4.

The obtained electrophotographic roller 1" was evaluated in the same manner as in Example 1. The evaluation results are shown in Table 6.

Example 9

An electrophotographic roller 1" having an EB-treated region on the surface of the elastic layer was obtained in the same manner as in Example 1, except that among the conditions of the electron-beam irradiation in Example 7, an electronic current was set at 4.5 mA and the electron-beam irradiation was performed. Z1, Z2 and the like are shown in Table 4.

The obtained electrophotographic roller 1" was evaluated in the same manner as in Example 1. The evaluation results are shown in Table 6.

Example 10

An electrophotographic roller was obtained in the same manner as in Example 1, except that the surface of the electrophotographic roller was not treated. Z1, Z2 and the like are shown in Table 4. The evaluation results are shown in Table 6.

Example 11

With the use of the crosshead extrusion molding machine used in Example 1, a coated roller was formed so that an outer diameter of 8.00 mm at the time when having been extruded from the molding machine became a straight shape. After that, the coated roller was heated in a hot air oven at 160° C. for 60 minutes, and an electrophotographic roller precursor was produced. Subsequently, both end portions of the vulcanized rubber layer were each removed by 10 mm, the surface of the vulcanized rubber layer of the electrophotographic roller precursor was ground by a plunge cut grinding type of grinding machine, and an electrophotographic roller 1''' was obtained of which the numerical values of Z1, Z2, (Do−DX2)/2 were as shown in Table 4. Except for that, the same procedure as those in Example 1 was employed. The evaluation results are shown in Table 6.

Example 12

The electrophotographic roller 1' produced in Example 1 was incorporated into an electrophotographic apparatus as a developing roller, and was subjected to a paper passing endurance test. Fogging was evaluated with the use of Laserjet Pro M102w Printer (manufactured by HP Inc.) as the electrophotographic apparatus. Firstly, the electrophotographic apparatus loaded with the electrophotographic roller 1' was placed in an environment of a temperature of 40° C. and a relative atmospheric humidity of 95%, and then was left to stand for 12 hours or longer.

Next, the reflectance R0(%) of the unprinted paper was measured.

Subsequently, an image of a black color having a printing rate of 1% was continuously output on 1000 sheets, and then the reflectance R1(%) was measured at the end portion of the image on the 1000th sheet.

For the measurement, a reflection densitometer (trade name: TC-6DS/A; manufactured by Tokyo Denshoku Co., Ltd.) was used.

Then, the fogging value calculated with the use of the following expression is shown in Table 6.

$$\text{Fogging value}=R0(\%)-R1(\%)$$

Example 13

The rubber among the materials of the unvulcanized rubber composition in Example 1 was changed from NBR (grade N230SV, produced by JSR Corporation) to NBR (grade N230SL, produced by JSR Corporation). Except for that, the same procedure as those of Example 1 was employed. Z1, Z2 and the like are shown in Table 4. The evaluation results are shown in Table 6.

Comparative Examples 1 and 2

Electrophotographic rollers 1' were obtained in the same manner as in Example 1, except that the values of Z1, Z2 and (Do−DX2)/2 were controlled as shown in Table 4. The obtained electrophotographic rollers 1' were evaluated in the same manner as in Example 1. The evaluation results are shown in Table 6.

Comparative Example 3

Electrophotographic rollers 1' were obtained in the same manner as in Example 1, except that the values of Z1, Z2 and (Do−DX2)/2 were controlled as shown in Table 4. The obtained electrophotographic roller 1' was evaluated in the same manner as in Examples 3 to 6. The evaluation results are shown in Table 6.

TABLE 4

| | Compounded rubber | L1 [mm] | L2 [mm] | Z1 [mm] | Z2 [mm] | (Z2/L2)/(Z1/Z1) | (Do − DX2)/2 [mm] | Forming method | Surface treatment | Incorporated location |
|---|---|---|---|---|---|---|---|---|---|---|
| Example 1 | N230SV | 69.0 | 46.0 | 0.1196 | 0.0804 | 1.008 | 0.200 | Extruded unground | UV treatment | Charging roller |
| Example 2 | N230SV | 69.0 | 46.0 | 0.1001 | 0.0999 | 1.497 | 0.200 | Extruded unground | UV treatment | Charging roller |
| Example 3 | N230SV | 69.0 | 46.0 | 0.0914 | 0.1086 | 1.782 | 0.200 | Extruded unground | UV treatment | Charging roller |
| Example 4 | N230SV | 69.0 | 46.0 | 0.0875 | 0.1125 | 1.930 | 0.200 | Extruded unground | UV treatment | Charging roller |
| Example 5 | N230SV | 69.0 | 46.0 | 0.0044 | 0.0056 | 1.909 | 0.010 | Extruded unground | UV treatment | Charging roller |
| Example 6 | N230SV | 69.0 | 46.0 | 0.1146 | 0.1455 | 1.904 | 0.260 | Extruded unground | UV treatment | Charging roller |
| Example 7 | N230SV | 69.0 | 46.0 | 0.1196 | 0.0804 | 1.008 | 0.200 | Extruded unground | EB treatment | Charging roller |
| Example 8 | N230SV | 69.0 | 46.0 | 0.1196 | 0.0804 | 1.008 | 0.200 | Extruded unground | EB treatment | Charging roller |
| Example 9 | N230SV | 69.0 | 46.0 | 0.1196 | 0.0804 | 1.008 | 0.200 | Extruded unground | EB treatment | Charging roller |
| Example 10 | N230SV | 69.0 | 46.0 | 0.1196 | 0.0804 | 1.008 | 0.200 | Extruded unground | No treatment | Charging roller |
| Example 11 | N230SV | 69.0 | 46.0 | 0.1196 | 0.0804 | 1.008 | 0.200 | Ground | UV treatment | Charging roller |
| Example 12 | N230SV | 69.0 | 46.0 | 0.1196 | 0.0804 | 1.008 | 0.200 | Extruded unground | UV treatment | Developing roller |
| Example 13 | N230SL | 69.0 | 46.0 | 0.1196 | 0.0804 | 1.008 | 0.200 | Extruded unground | UV treatment | Charging roller |
| Example 14 | N230S | 69.0 | 46.0 | 0.1196 | 0.0804 | 1.008 | 0.200 | Extruded unground | UV treatment | Charging roller |
| Comparative Example 1 | N230SV | 69.0 | 46.0 | 0.1875 | 0.01250 | 0.100 | 0.200 | Extruded unground | UV treatment | Charging roller |
| Comparative Example 2 | N230SV | 69.0 | 46.0 | 0.08360 | 0.1165 | 2.089 | 0.200 | Extruded unground | UV treatment | Charging roller |
| Comparative Example 3 | N230SV | 69.0 | 46.0 | 0.08714 | 0.1127 | 1.940 | 0.200 | Extruded unground | UV treatment | Charging roller |

Example 14

The rubber among the materials of the unvulcanized rubber composition in Example 1 was changed from NBR (grade N230SV, produced by JSR Corporation) to NBR (grade N230S, produced by JSR Corporation). Except for that, the same procedure as those in Example 1 was employed. Z1, Z2 and the like are shown in Table 4. The evaluation results are shown in Table 6.

TABLE 5

| Rank | Microscopic observation result of surface of charging roller (adhesion of blot of toner and external additive) | Visual inspection result of halftone image (image defect originating in adhesion of blot) |
|---|---|---|
| 1 | Extremely slight | None |
| 2 | Slight | Extremely slight |
| 3 | Present | Slight |

TABLE 5-continued

| Rank | Microscopic observation result of surface of charging roller (adhesion of blot of toner and external additive) | Visual inspection result of halftone image (image defect originating in adhesion of blot) |
|---|---|---|
| 4 | Many | Present |
| 5 | Extremely many | Many |

TABLE 6

| | Asker C hardness | Elastic deformation power η\|T | Magnitude of vibration (nm) | Blot on the roller surface Rank | Halftone image Rank | Fogging (%) |
|---|---|---|---|---|---|---|
| Example 1 | 74 | 45 | 5 | 2 | 2 | — |
| Example 2 | 74 | 45 | 7 | 2 | 2 | — |
| Example 3 | 74 | 45 | 9 | 3 | 3 | — |
| Example 4 | 74 | 45 | 12 | 3 | 3 | — |
| Example 5 | 74 | 45 | 10 | 3 | 3 | — |
| Example 6 | 74 | 45 | 10 | 3 | 3 | — |
| Example 7 | 75 | 56 | 5 | 2 | 1 | — |
| Example 8 | 76 | 65 | 5 | 2 | 1 | — |
| Example 9 | 77 | 85 | 5 | 2 | 1 | — |
| Example 10 | 73 | 40 | 5 | 3 | 3 | — |
| Example 11 | 74 | 45 | 5 | 2 | 2 | — |
| Example 12 | 74 | 45 | — | — | — | 6.1 |
| Example 13 | 76 | 47 | 5 | 2 | 2 | — |
| Example 14 | 79 | 49 | 5 | 2 | 2 | — |
| Comparative Example 1 | 74 | 45 | 4 | 5 | 5 | — |
| Comparative Example 2 | 74 | 45 | 15 | 4 | 4 | — |
| Comparative Example 3 | 74 | 45 | 15 | 4 | 4 | — |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-093293, filed Jun. 2, 2021, and Japanese Patent Application No. 2022-076789, filed May 6, 2022, which are hereby incorporated by reference herein in their entirety.

What is claimed is:

1. An electrophotographic roller comprising a mandrel and an elastic layer on the mandrel; and having a crown shape in which a diameter decreases from a central position O in a longitudinal direction of the mandrel toward both ends thereof, wherein when a position of the end portion in the longitudinal direction of the elastic layer is defined as X2, a position between the central position O and the X2 is defined as X1, a distance between the central position O and the X1 is defined as L1, and a distance between the X1 and the X2 is defined as L2, $L1=0.6\times(L1+L2)$, and when outer diameters of the electrophotographic roller at O, X1 and X2 are defined as Do, DX1 and DX2, respectively, and Z1 and Z2 are defined as follows:

$Z1=(Do-DX1)/2$, and $Z2=(DX1-DX2)/2$ then Z1, Z2, L1 and L2 satisfy a relationship expressed by the following calculation expression (1):

$$(Z2/L2)<\alpha\times(Z1/L1) \quad (1),$$

wherein α is 1.931.

2. The electrophotographic roller according to claim 1, wherein the electrophotographic roller satisfies 1.000<[(Z2/L2)/(Z1/L1)]<1.931.

3. The electrophotographic roller according to claim 1, wherein (Do−DX2)/2 is 0.01 mm or larger and 0.26 mm or smaller.

4. The electrophotographic roller according to claim 1, wherein an elastic deformation power of the elastic layer is 56% or higher.

5. The electrophotographic roller according to claim 1, wherein the elastic layer contains acrylonitrile butadiene rubber.

6. The electrophotographic roller according to claim 1, wherein the elastic layer has an Asker C hardness of 10 degrees or higher and 70 degrees or lower.

7. The electrophotographic roller according to claim 1, wherein a length of the elastic layer in the longitudinal direction is 220 mm or longer and 340 mm or shorter.

8. A process cartridge that is detachably attachable to a main body of an electrophotographic image forming apparatus, comprising:

an electrophotographic photosensitive member; and an electrophotographic roller in contact with the electrophotographic photosensitive member, wherein the electrophotographic roller comprises a mandrel and an elastic layer on the mandrel; and has a crown shape in which a diameter decreases from a central position O in a longitudinal direction of the mandrel toward both ends thereof; and when a position of the end portion in the longitudinal direction of the elastic layer is defined as X2, a position between the central position O and the X2 is defined as X1, a distance between the central position O and the X1 is defined as L1, and a distance between the X1 and the X2 is defined as L2, L1=0.6×(L1+L2), and when outer diameters of the electrophotographic roller at O, X1 and X2 are defined as Do, DX1 and DX2, respectively, and Z1=(Do−DX1)/2 and Z2=(DX1−DX2)/2 are defined, Z1, Z2, L1 and L2 satisfy a relationship expressed by the following calculation expression (1):

$$(Z2/L2)<\alpha\times(Z1/L1) \quad (1),$$

wherein α is 1.931.

9. The process cartridge according to claim 8, wherein the electrophotographic roller is a charging roller that electrically charges the electrophotographic photosensitive member.

10. An electrophotographic image forming apparatus comprising:

an electrophotographic photosensitive member; and an electrophotographic roller in contact with the electrophotographic photosensitive member, wherein the electrophotographic roller comprises a mandrel and an elastic layer on the mandrel; and has a crown shape in which a diameter decreases from a central position O in a longitudinal direction of the mandrel toward both ends thereof; and when a position of the end portion in the longitudinal direction of the elastic layer is defined as X2, a position between the central position O and the X2 is defined as X1, a distance between the central position O and the X1 is defined as L1, and a distance between the X1 and the X2 is defined as L2, L1=0.6×(L1+L2), and when outer diameters of the electrophotographic roller at O, X1 and X2 are defined as Do, DX1 and DX2, respectively, and Z1=(Do−DX1)/2 and Z2=(DX1−DX2)/2 are defined, Z1, Z2, L1 and L2 satisfy a relationship expressed by the following calculation expression (1):

$$(Z2/L2)<\alpha\times(Z1/L1) \quad (1),$$

wherein α is 1.931.

11. The electrophotographic image forming apparatus according to claim 10, wherein the electrophotographic roller is a charging roller that electrically charges the electrophotographic photosensitive member.

12. The electrophotographic image forming apparatus according to claim 11, wherein the electrophotographic photosensitive member is driven, and the charging roller rotates following the rotation of the electrophotographic photosensitive member.

* * * * *